US006543399B2

(12) United States Patent
Heer

(10) Patent No.: US 6,543,399 B2
(45) Date of Patent: Apr. 8, 2003

(54) APPARATUS FOR ADJUSTING A CAMSHAFT

(75) Inventor: Siegfried Heer, Kirchdorf/Krems (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 25 days.

(21) Appl. No.: 09/801,866

(22) Filed: Mar. 9, 2001

(65) Prior Publication Data

US 2001/0020460 A1 Sep. 13, 2001

(30) Foreign Application Priority Data

Mar. 9, 2000 (AU) ..... A 389/2000

(51) Int. Cl.[7] ..... F01L 1/34

(52) U.S. Cl. ..... 123/90.17; 123/90.11; 123/90.15; 123/90.16; 123/90.18

(58) Field of Search ..... 123/90.11, 90.15, 123/90.16, 90.17, 90.18

(56) References Cited

U.S. PATENT DOCUMENTS

| | | | | |
|---|---|---|---|---|
| 4,305,352 A | * | 12/1981 | Oshima et al. | 123/90.15 |
| 4,986,801 A | * | 1/1991 | Ohlendorf et al. | 475/331 |
| 5,174,253 A | * | 12/1992 | Yamazaki et al. | 123/90.17 |
| 5,680,837 A | * | 10/1997 | Pierik | 123/90.17 |
| 6,129,061 A | * | 10/2000 | Okuda et al. | 123/90.17 |
| 6,138,622 A | * | 10/2000 | Heer | 123/90.17 |

FOREIGN PATENT DOCUMENTS

| | | |
|---|---|---|
| DE | 4110195 | 10/1992 |
| DE | 4133408 | 4/1993 |
| EP | 0143368 | 6/1985 |
| EP | 0903471 | 3/1999 |
| GB | 649221 | 1/1951 |

* cited by examiner

*Primary Examiner*—Thomas Denion
*Assistant Examiner*—Ching Chang
(74) *Attorney, Agent, or Firm*—Dykema Gossett PLLC

(57) ABSTRACT

The present invention relates to an apparatus for adjusting a camshaft of an internal combustion engine with at least one electromotor which produces, by way of a planetary gear, the adjustment of the camshaft with respect to a pinion, with the planetary gear comprising a first ring gear and a second ring gear as well as at least a first planet wheel which is in engagement with the first ring gear and at least a second planet wheel which is in engagement with the second ring gear and which is rigidly connected with the first planet wheel. An efficient position with low adjusting moments is achieved in such a way that several planet sets are provided which each consist of a first planet wheel and a second planet wheel, that the pinion is fixedly connected with the first ring gear, that the camshaft is fixedly connected with the second ring gear, that the first planet wheel and the second planet wheel have a slightly different diameter and that the first planet wheel and the second planet wheel are held on a planet cage which is held concentrically to the axle of the camshaft and the pinion.

10 Claims, 2 Drawing Sheets

APPARATUS FOR ADJUSTING A CAMSHAFT

BACKGROUND OF THE INVENTION

The present invention relates to an apparatus for adjusting a camshaft of an internal combustion engine with at least one electromotor which produces, by way of a planetary gear, the adjustment of the camshaft with respect to a pinion, with the planetary gear comprising a first ring gear and a second ring gear as well as at least one planet wheel which is in engagement with the first ring gear and at least a second planet wheel which is in engagement with the second ring gear and which is rigidly connected with the first planet wheel.

DESCRIPTION OF PRIOR ART

An apparatus for adjusting the camshaft of an internal combustion engine is known from EP 0 903 471 A which comprises a planetary gear. The ratio of transmission is limited in this apparatus, however, so that a relatively large electromotor needs to be used in order to generate the required adjusting moment. Moreover, the tooth flank play of the planetary gear has a disadvantageous effect on the operating noise and the service life of the apparatus.

DE 41 33 408 A shows a camshaft adjusting device with a planetary gear which comprises two ring gears which are rigidly connected with one another and each show a slightly different diameter. Each of the ring gears is in engagement with a planet wheel, with one of the planet wheels being connected with the camshaft and the other one with the pinion. The two ring gears are held eccentrically to the axis of the camshaft and the pinions in a sleeve which on its part is rotatably held about the camshaft axle. When the sleeve rotates with the rotational speed of the camshaft, there is no adjustment with respect to the pinion. A respective relative movement of the camshaft with respect to the pinion can be achieved by braking or accelerating the sleeve. In such an apparatus it is difficult to control the occurring inertia forces and the gearings are subjected to relatively strong stresses.

Furthermore, EP 0 143 368 A shows a shaft coupling system which allows a relative adjustment between a drive shaft and a camshaft. Two planetary gears are switched behind one another by mutually connected planet cages. The relative adjustment can be produced in such a way that the two mutually concentrically arranged ring gears can be twisted with respect to one another. In this apparatus, however, the planet wheels are in motion even in stationary operation, which leads to respective losses and production of noise. The same applies to a gear as has been disclosed in GB 649 221 A.

SUMMARY OF THE INVENTION

It is the object of the present invention to avoid such disadvantages and to improve an apparatus of the kind mentioned above in such a way that a secure adjustment with low losses is achieved and the required torque is kept as low as possible.

These objects are achieved in accordance with the invention in such a way that several planet sets are provided which each consist of a first planet wheel and a second planet wheel, that the pinion is fixedly connected with the first ring gear, that the camshaft is fixedly connected with the second ring gear, that a first ratio of transmission between the first planet wheel and the first ring gear and a second ratio of transmission between the second planet wheel and the second ring gear differ slightly from one another and that the first planet wheel and the second planet wheel are held on a planet cage which is held concentrically to the axle of the camshaft and the pinion. An important feature of the present invention is that in stationary operation, meaning that when an adjustment of the camshaft is performed, there is no rolling off of the planet wheels in the ring gears. In this way it is possible to keep the losses low and noise generation is also low. As a result of the arrangement in accordance with the invention it is possible to achieve a high ratio of transmission, so that an electromotor with a relatively low torque can be used. The ratio of transmission becomes larger the lower the difference between the effective diameter of the two ring gears. The electromotor can be arranged in principle as a following electromotor as is described in EP 0 903 471 A or also as a fixed electromotor as is shown in DE 41 10 195 A. As a result of the fact that several planet wheels are arranged at regular angular intervals about the central point, it is possible without any special measures in the arrangement in accordance with the invention to produce a rotation without any occurring free masses or moments.

In a preferred embodiment of the invention it is provided that the housing of the electromotor is rigidly connected with the camshaft or the drive shaft and that the electromotor is supplied by way of slip rings with power. A standstill of the electromotor means in such an embodiment that no adjustment of the camshaft with respect to the drive shaft is produced. Stationary operation is thus easily possible.

As an alternative thereto it can also be provided that the stator of the electromotor is arranged fixedly with the housing. In such an embodiment the electromotor must run with a speed which is proportional to the rotational speed of the camshaft. An adjustment is performed by accelerating or braking the electromotor.

The tooth flank play can be simply reduced or completely avoided in that the planet sets are arranged movably in the radial direction. In this way the noise production can be reduced even further. It is particularly advantageous in this connection when the planet sets are provided with an arrangement so as to be pressable against the ring gears by means of a spring.

A constructionally particularly preferable embodiment of the invention is characterized in that the housing of the electromotor is attached to the planet cage. In this embodiment the electromotor revolves in its entirety about the camshaft axle, with the axles of the planet wheels coinciding with the axle of the electromotor. A further embodiment of the invention provides that the electromotor carries a pinion gear which is in engagement with the first planet wheel or the second planet wheel. In this way it is possible to favorably use a fixed electromotor which can be driven without using slip rings.

It is provided for in a special embodiment of the invention that the first planet wheel and the second planet wheel are provided with an integral arrangement and with the same toothing and that at least one ring gear is provided with a profile offset. In this way the first planet wheel and the second planet wheel can be arranged practically indistinguishably as a single gearwheel. In this way the pinion gear of the electromotor can engage in both planet wheels, thus achieving a particularly favorable embodiment with respect to stability. The different profile offset of the ring gears leads to a different virtual rolling-off diameter. It is particularly advantageous in this connection when the tooth count of the first planet wheel and the second planet wheel is the same and that the tooth counts of the first ring gear and the second ring gear are slightly different, with the difference preferably amounting to as many teeth as planet sets are provided. If two planet sets are provided, the ring gears can have 100 and 102 teeth, as a result of which the ratios of transmission between planet wheel and first or second ring gear differ only very marginally. In this way it is possible to make the ratio of transmission between electromotor and the adjusting movement very large.

BRIEF DESCRIPTION OF THE DRAWINGS

The present invention is now explained in closer detail by reference to the embodiments shown schematically in the drawings, wherein.

DETAILED DESCRIPTION OF THE PREFERRED EMBODIMENTS

Figure 1:
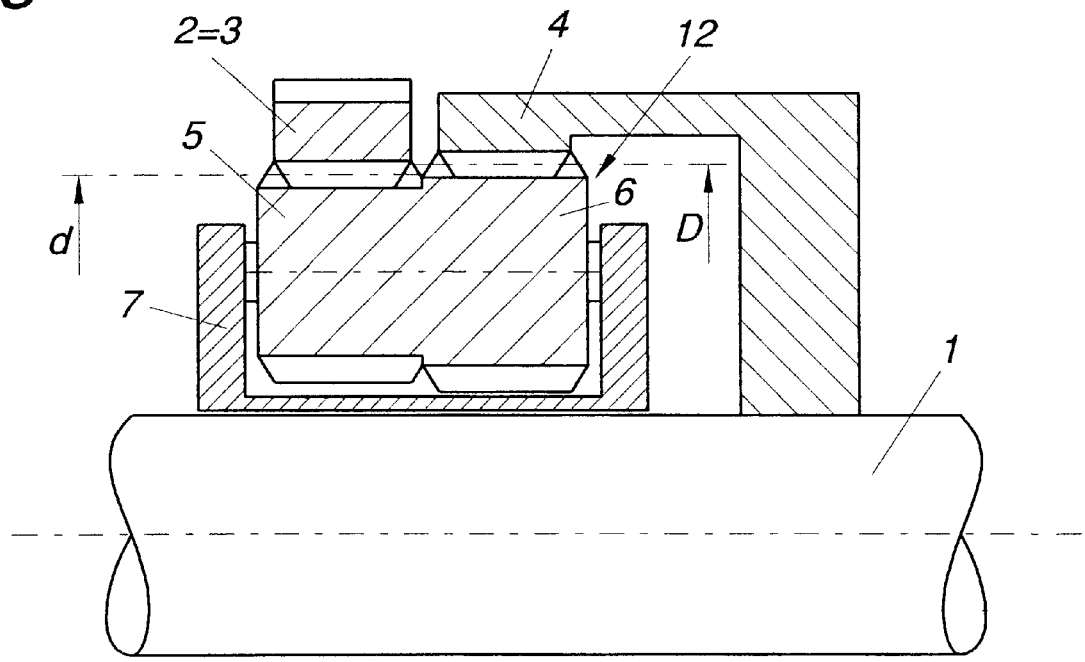
FIG. 1 shows a general representation of the relevant parts of an apparatus in accordance with the invention.

FIG. 1 schematically shows a general situation which applies substantially to all embodiments of the invention. A camshaft 1 is driven by a pinion 2 which can be arranged as a toothed pulley or as a chain wheel. The pinion 2 is connected integrally with first ring gear 3, while the camshaft 1 is torsionally rigidly connected with a second ring gear 4.

The diameters d, D of the ring gears 3, 4 differ slightly. Diameter d of the first ring gear 3 for example can be between 96% and 98% of diameter D of the second ring gear 4. A first planet wheel 5 is in engagement with the first ring gear 3 and is arranged integrally with a second planet wheel 6, which is in engagement with the second ring gear 4. The planet set 12 which is formed by the first planet wheel 5 and the second planet wheel 6 is rotatably held in a planet cage 7, which on its part is rotatably held on the camshaft 1. The electromotor for adjusting the camshaft 1 is not shown in FIG. 1. There are the following embodiments for arranging the electromotor:

a) The housing of the electromotor is held on the camshaft and the electromotor 8 rotates the planet cage 7 with respect to camshaft 1.

b) The electromotor is fixedly arranged and drives the planet cage 7. An adjusting movement occurs when the electromotor 8 runs faster or slower than the camshaft 1.

c) The electromotor 8 is held in the planet cage 7 and drives the planet wheels 5 and 6.

d) The electromotor 8 is connected with the camshaft 1 and is engagement with a planet wheel 5, 6.

e) The electromotor 8 is stationary and is in engagement with a planet wheel 5, 6.

Figure 2:
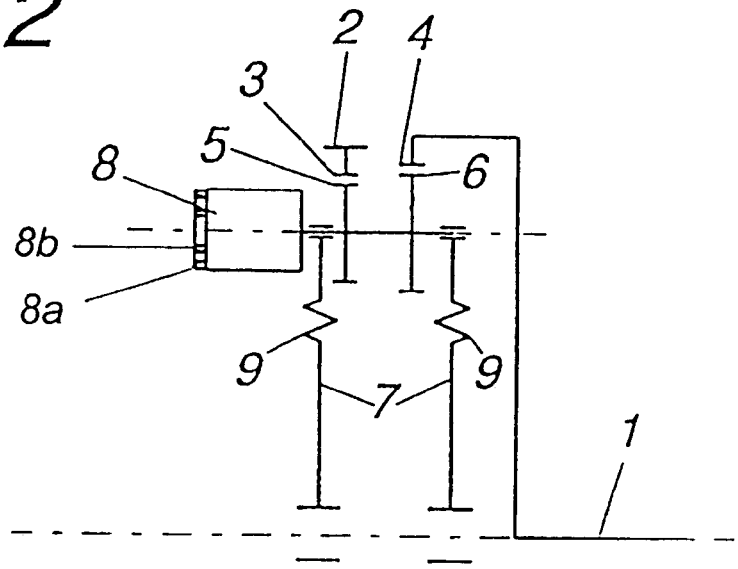
FIGS. 2 and 3 show gearing diagrams of different embodiments of the invention.

In the gearing diagram of FIG. 2, the variant c) is shown. It is shown that the electromotor 8 is fastened to the planet cage and drives the planet wheels 5, 6 directly. Depending on the present conditions of forces, between three and seven electromotors 8 and planet sets 12 which are connected thereto and are composed of planet wheels 5, 6 can be provided. In order to minimize the tooth flank play, springs 9 can be provided in the planet cage 7 which press the planet sets 12 against the ring gears 3, 4. The power supply of the electromotors 8 is performed in this solution by slip rings 8*a*, 8*b*.

Figure 3:
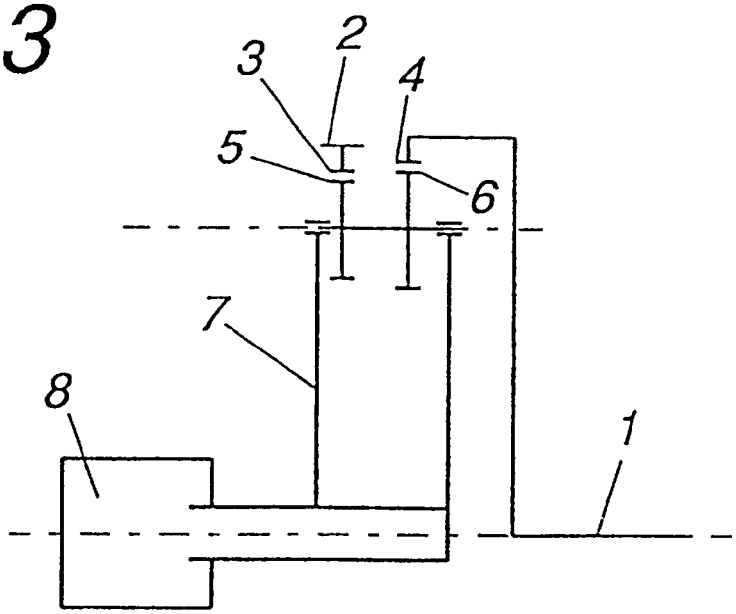

In the embodiment shown schematically in FIG. 3 a stationary electromotor 8 drives the planet cage 7 directly. A camshaft adjustment is performed by accelerating or braking the movement of the electromotor 8 towards camshaft 1.

Figure 4:
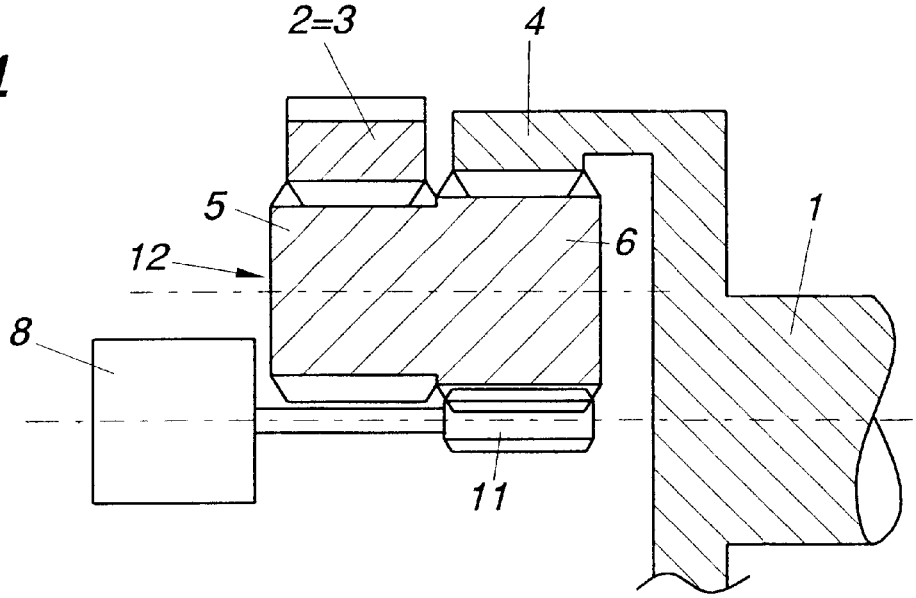
FIG. 4 shows a further embodiment of the invention in a longitudinal sectional view.

In the embodiment of FIG. 4 the electromotor 8, which can also be provided with a stationary arrangement and be connected with the camshaft 1, drives the second planet wheel 6 via a pinion gear 11. The planet cage is not shown in this figure to simplify the illustration. Because the pinion gear 11 is provided with a small diameter, a large ratio of transmission is achieved.

The present invention allows achieving the adjustment of a camshaft with respect to a pinion in a very simple manner with relatively low adjusting moments. Frictional losses are low and the development of noise is limited.

What is claimed is:

1. An apparatus for adjusting a camshaft of an internal combustion engine with at least one electromotor which produces, by way of a planetary gear system, the adjustment of the camshaft with respect to a pinion, the planetary gear system comprising a first ring gear and a second ring gear, as well as several planet sets, each planet set including a first planet wheel which is in engagement with the first ring gear and a second planet wheel which is in engagement with the second ring gear and which is rigidly connected with the first planet wheel, wherein the pinion is fixedly connected with the first ring gear, the camshaft is fixedly connected with the second ring gear, a first ratio of transmission between the first planet wheel and the first ring gear and a second ratio of transmission between the second planet wheel and the second ring gear differ slightly from one another, and the first planet wheel and the second planet wheel are held on a planet cage which is held concentrically to the axle of the camshaft and the pinion.

2. An apparatus according to claim 1, wherein the electromotor includes a housing rigidly connected with the camshaft or a drive shaft and the electromotor includes slip rings for connection to a source of power.

3. An apparatus according to claim 2, wherein the electromotor includes a stator arranged fixedly with the housing.

4. An apparatus according to claim 1, wherein the planet sets are arranged to be radially movable relative to the camshaft.

5. An apparatus according to claim 4, including springs for pressing the planet sets against the ring gears.

6. An apparatus according to claim 4, wherein the electromotor includes a housing fastened to the planet cage.

7. An apparatus according to claim 4, wherein the electromotor carries a pinion gear which is in engagement with the first planet wheel or the second planet wheel.

8. An apparatus according to claim 1, wherein each first planet wheel and second planet wheel are provided with an integral arrangement and with the same toothing, and at least one ring gear is provided with a profile offset.

9. An apparatus according to claim 8, wherein tooth counts of each first planet wheel and each second planet wheel are the same, and wherein tooth counts of the first ring gear and the second ring gear differ slightly from one another, a difference amounting to precisely as many teeth as planet sets provided.

10. An apparatus according to claim 1, including between three and seven planet sets which each consist of a first planet wheel and a second planet wheel which have a slightly different diameter.

* * * * *

UNITED STATES PATENT AND TRADEMARK OFFICE

CERTIFICATE OF CORRECTION

PATENT NO. : 6,543,399 B2
DATED : April 8, 2003
INVENTOR(S) : Siegfried Heer

It is certified that error appears in the above-identified patent and that said Letters Patent is hereby corrected as shown below:

Title page,
Item [30], Foreign Application Priority, replace present script with the following:
-- Mar. 9, 2000 (AT).....A 389/2000 --

Signed and Sealed this

Ninth Day of September, 2003

JAMES E. ROGAN
*Director of the United States Patent and Trademark Office*